US006793549B1

(12) United States Patent
Chiang

(10) Patent No.: US 6,793,549 B1
(45) Date of Patent: Sep. 21, 2004

(54) BUOYANCY AID FOR SWIMMING AND TRAINING

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 0 days.

(21) Appl. No.: 10/407,183

(22) Filed: Apr. 7, 2003

(51) Int. Cl.[7] ..... B63C 9/08
(52) U.S. Cl. ..... 441/88; D21/804
(58) Field of Search ..... 441/55, 60, 88, 441/129, 136; D21/804, 803

(56) References Cited

U.S. PATENT DOCUMENTS 4,362,518 A * 12/1982 Boissiere ..... 441/60
4,379,704 A * 4/1983 Rademacher ..... 441/88
4,929,205 A * 5/1990 Jones ..... 441/60
5,176,555 A * 1/1993 Burns ..... 441/129

* cited by examiner

*Primary Examiner*—Jesus D. Sotelo
(74) *Attorney, Agent, or Firm*—Troxell Law Office PLLC

(57) ABSTRACT

A buoyancy aid (1) having an integrally formed body (10) with an inner space (14) formed therein. The body (10) has a spherical portion (11) and a stopper portion (12), and a connection portion (13) formed therebetween to join them together and form the continuously smooth outer surface of the body (10). A hole (16) is formed at one end of the spherical portion (11) to communicate the inner space (14) with the outer circumference. A plug (2) is installed in the hole (16) to seal the hole (16) if necessary and the plug (2) can be pulled out to allow water or air from the outer circumference to enter the inner space (14) so as to adjust buoyancy of the buoyancy aid (1). Two layers (15) of specially treated material is mounted respectively on two opposing lateral faces of the connection portion (13) to provide a soft and easily holding surface thereon for legs of a swimmer so as to facilitate the user of the buoyancy aid (1) during swimming.

5 Claims, 7 Drawing Sheets

BUOYANCY AID FOR SWIMMING AND TRAINING

BACKGROUND OF THE INVENTION

1. Field of the Invention

The present invention is relates to an improved buoyancy aid for floating legs and lower torso of a swimmer as during the development of arm stroking techniques, strength and endurance, especially to a buoyancy aid which has adjustable buoyancy and an improved contacting surface for reliable and convenient use.

2. Description of Related Art

Swimming is a popular exercise and excellent method for body figuration and health maintenance. However, to get the most effective result or body benefit after swimming, especially for a competitive swimmer, efficient swimming posture should be learned by swimmers first. Except for the help of a good trainer, various different forms of swimming practice aides and other devices are usually useful to assist swimmers with swimming learning. In particular, these aids or devices are also beneficial to swimmers practicing different ways of swimming, including the butterfly, backstroke, breaststroke and freestyle swimming stroke. One kind of the aids or devices is in regard to flotation devices which are employed to effect or supplement flotation and provide total or partial immobilization of a portion or portions of a swimmer's body in order to concentrate on the development of techniques involving other body portions involved in a total stroke makeup. Examples of devices of this nature are buoyancy aids for legs and kickboards which have been developed in a variety of forms. In regard particularly to leg buoyancy aids, such devices are employed to provide flotation for the legs of a swimmer and to substantially immobilize the legs of a swimmer against movement relative to each other, while permitting the development of improved techniques or strength and endurance with respect to arm motions and/or breathing techniques.

Leg buoyancy aids of various types have been developed primarily from inflated or foam materials which within limited size constraints produce significant buoyant assist to the legs of a swimmer. "Kick Board", for instance, is usually formed with a rectangular shape by using foam material. U.S. Pat. Nos. 4,406,628, 4,781,638 and 5,518,429 all disclose a specialized kind of kick boards. As how a kick board is named, kick boards are usually hand-held to train the legs of swimmers. In a circumstance without enough professional equipment, kick boards can be used as a leg buoyancy aid by holding one of the kick boards between legs of a swimmer. It is understood that the rectangular shape of a kick board is hard to hold by legs. Therefore, a buoyancy aid having two enlarged portions joined by a thinner connecting portion to position the enlarged portion above and below the legs of a swimmer is helpful to be conveniently held. In some instances, composite flotation elements have been provided which effect some extent of conformance with body contours to assist in the selective retention of the leg buoyancy aid with minimal leg effort on the part of the swimmer. Rademacher U.S. Pat. No. 4,379,704 shows a similar device following the same design idea. However, while the flotation objective has been generally achieved by most of these devices, the adaptability of these devices to swimmers of different sizes and weights has been inadequate in many instances. In addition, some of these devices have not been constructed in such a fashion and surface as to be easily or steadily held by a swimmer which inevitably results in the need of struggling from the swimmer to hold these buoyancy aids.

SUMMARY OF THE INVENTION

Accordingly, an object of the present invention is to provide a buoyancy aid which is effective in supplementing the buoyancy of legs of a swimmer for exercise or drills directed to improving breathing techniques or arm stroking techniques, strength and endurance.

Another object of the present invention is to provide a buoyancy aid which has a universal configuration for easy retention by the legs of a swimmer irrespective of the particular size and shape of the legs of the swimmer.

A further object of the invention is to provide a buoyancy aid which can be successfully employed by swimmers of substantially different sizes and weights, i.e., from children to adults with the least needed effort.

A further object of the present invention is to provide a buoyancy aid having varied buoyancy in order to help swimmers of substantially different sizes and weights according to the actually need of the swimmers, and the desired buoyancy of the buoyancy aid is almost fixed or unchanged in water after the buoyancy of the buoyancy aid is decided because the content of the buoyancy aid is flowable or movable inside the buoyancy aid to slightly adjust buoyancy of the buoyancy aid.

In order to achieve the objects set forth, a buoyancy aid includes an integrally formed a body having an inner space formed therein. The body has a spherical portion and a stopper portion, and a connection portion formed therebetween to join them together and being shaped according to a prolate having a outer surface being continue and smooth. The inner space is formed inside of the body and a hole is formed at one end of the spherical portion to communicate the inner space with the outer circumstance.

Especially, a plug installed on the hole is selectively pulled out to allow water or air from the outer circumstance to-enter the inner space so as to adjust buoyancy of the buoyancy aid. And the poured water in the buoyancy aid is able to move toward the buoyancy aid under water to stabilize or balance buoyancy of the buoyancy aid in water and a swimmer can easily control or use it. Besides, two layers of specially treated material is mounted respectively on two opposing lateral faces of the connection portion to provide a soft and easily holding surface thereon for legs of a swimmer so as to facilitate the use of the buoyancy aid during swimming.

Other objects, advantages and novel features of the invention will become more apparent from the following detailed description when taken in conjunction with the accompanying drawings.

BRIEF DESCRIPTION OF THE DRAWINGS AND DIAGRAMS

DETAILED DESCRIPTION OF THE INVENTION

Figure 1:
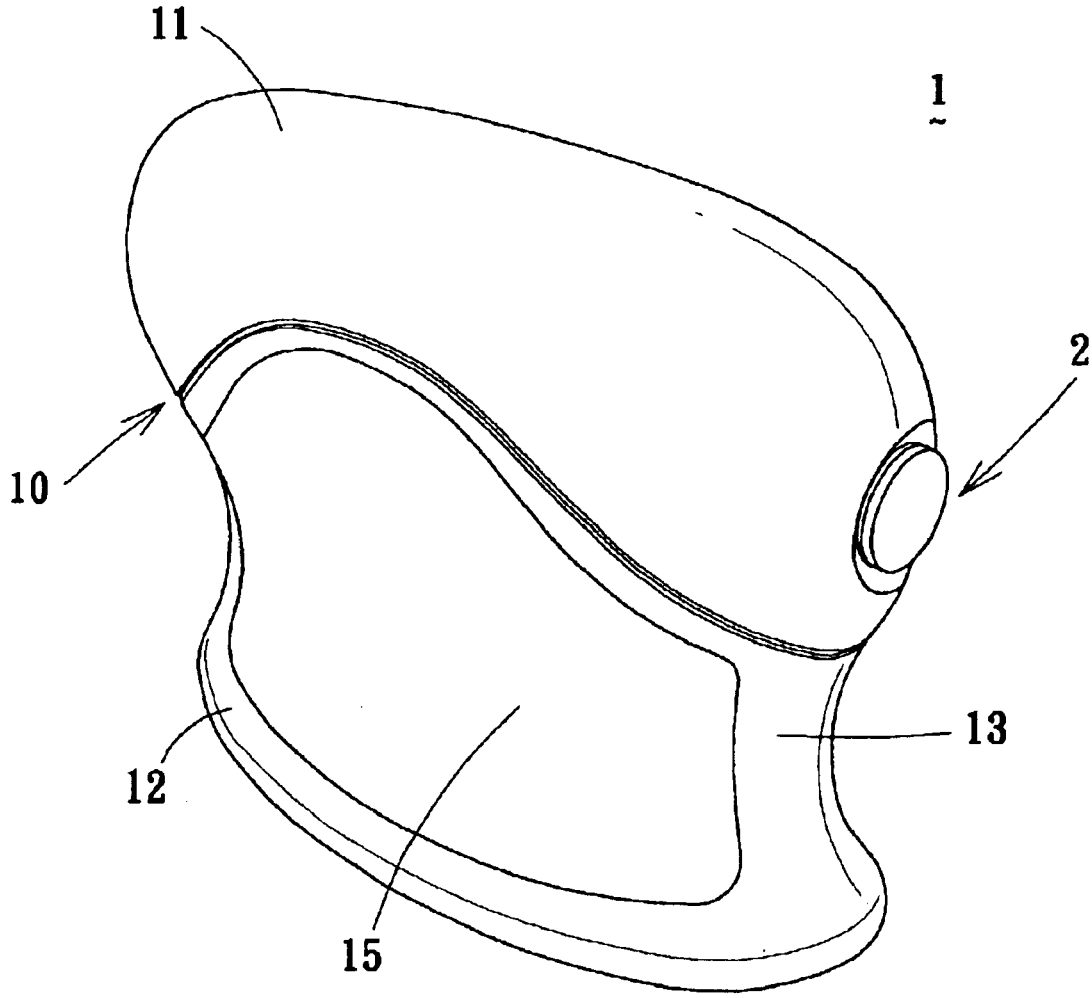
FIG. 1 is a perspective view of a buoyancy aid in accordance with the present invention.

Reference will now be made to the drawing figure to describe the present invention in detail.

Figure 2:
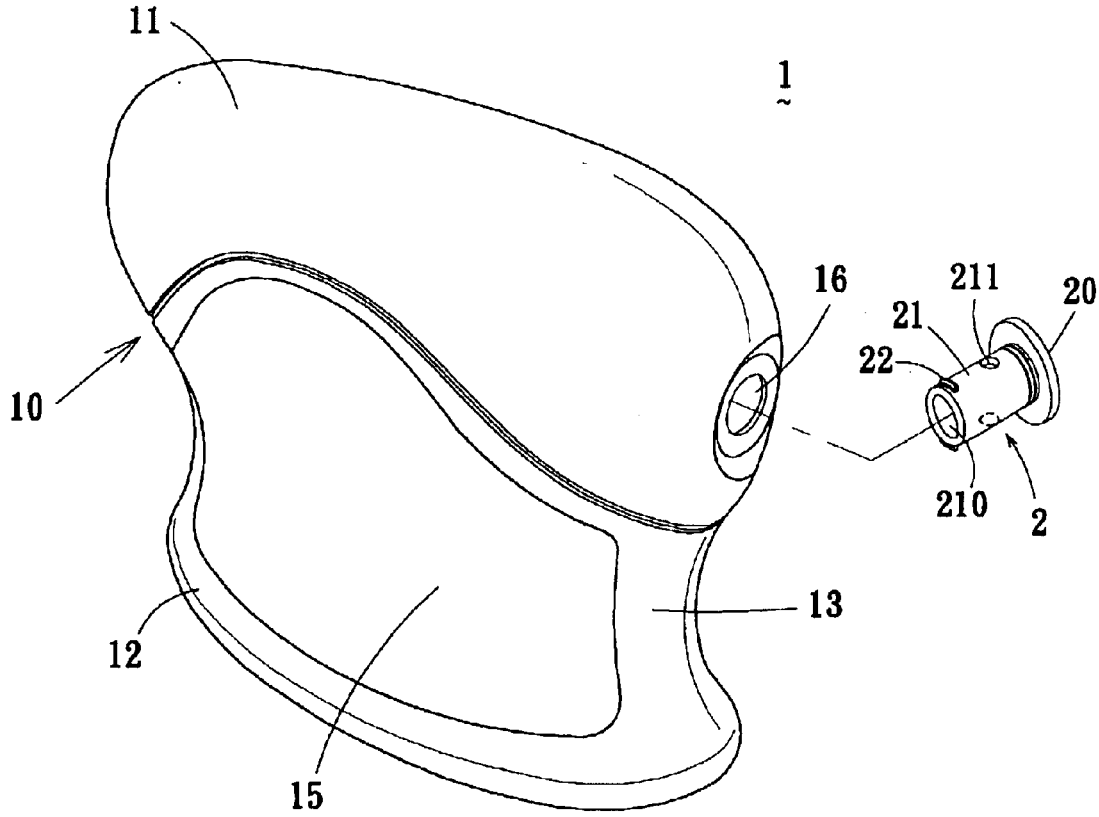
FIG. 2 is an exploded view of the buoyancy aid as shown in FIG. 1.
Figure 3:
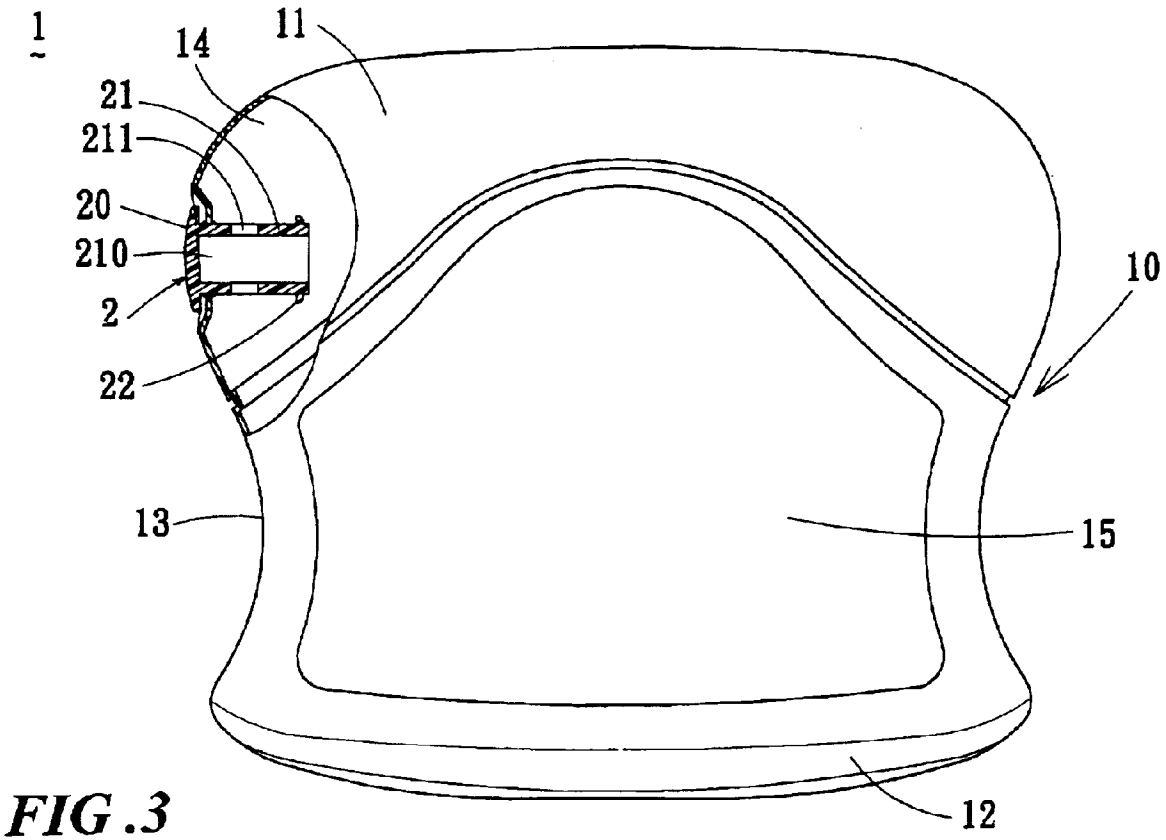
FIG. 3 is a lengthwise side plan view of the buoyancy aid as showing in FIG. 1 with a sectional-viewed portion showing the close status of the buoyancy aid.
Figure 5:
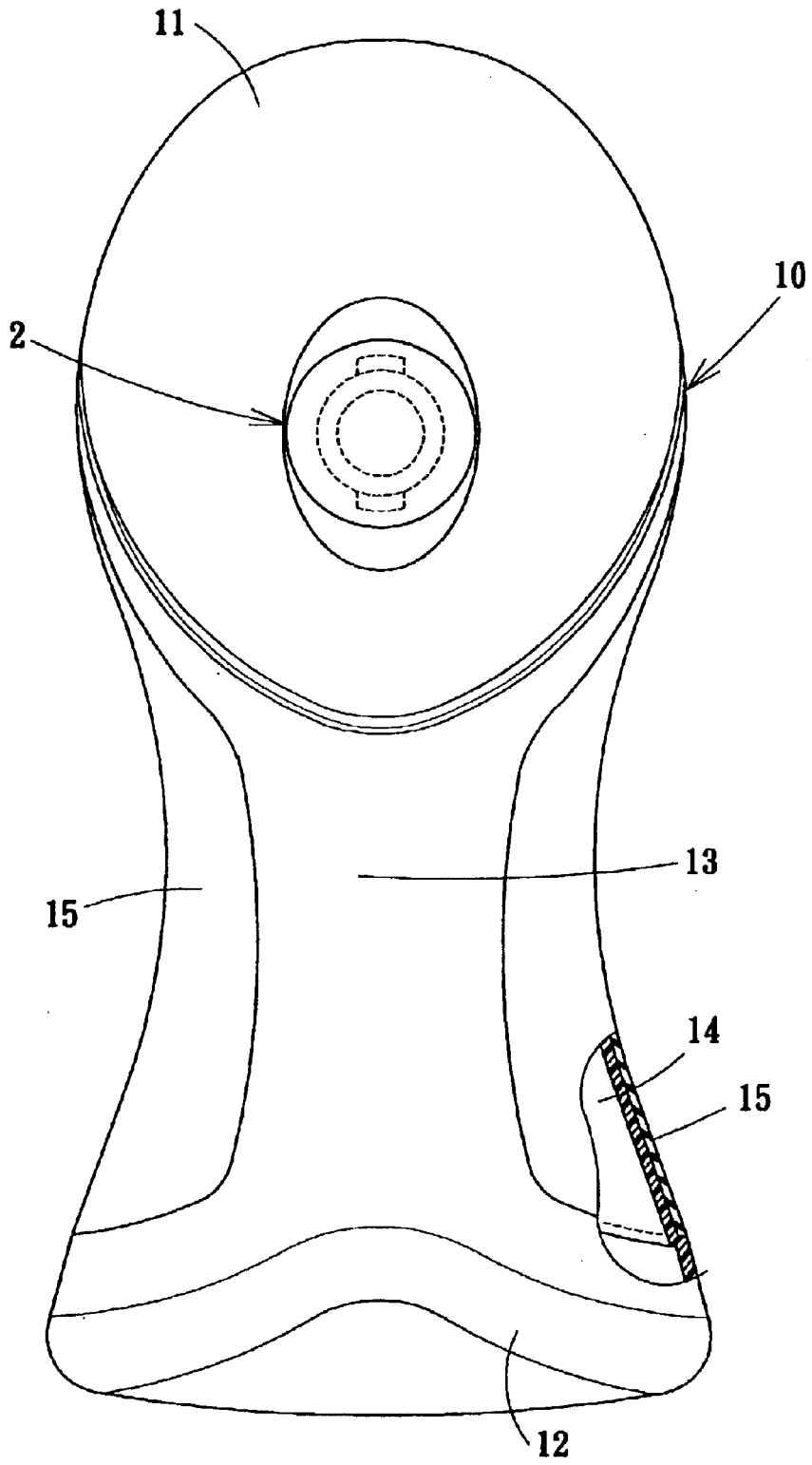
FIG. 5 is a transverse side plan view of the buoyancy aid as showing in FIG. 1 with a sectional-viewed portion showing constitutive wall layers of the buoyancy aid.

Referring to FIGS. 1, 2 and 3, the present invention is relates to a buoyancy aid 1 for floating legs and lower torso of a swimmer as during the development of arm stroking techniques, strength and endurance. The buoyancy aid 1 comprises an integrally formed, unitary body 10. The body 10 is shaped according to a prolate having a outer surface being continue and smooth. And the body 10 has a spherical portion 11 and a stopper portion 12 the spherical portion 11 is a substantially spherical hollow body and the stopper portion 12 is a substantially prolate hollow body, formed respectively at two opposing sides of the body 10 to be spaced from each other and a connection portion 13 formed therebetween to join the spherical portions 11 and the stopper portion 12 together and formed the continuously smooth outer surface of the body 10 that is holding area. An inner space 14 is located inside the body 10 and extends from the spherical portion 11 to the stopper portion 12 by continuously extending in the connection portion 13. Also, the connection portion 13 is recessed toward center and the whole periphery of the body 10 for providing comfortable holding the buoyancy aid 1 between legs of a swimmer. Referring further to FIG. 5, two layers 15 of specially treated material, which can generate considerable friction between one of the layers 15 and any object abutting against the whole surface of die layer 15, are respectively paved on two opposing lateral faces of the connection portion 13. A hole 16 is formed at one end of the spherical portion 11 and a plug 2 is used to fill the hole 16 tightly. The plug 2 has a cover portion 20 and a tube-like portion 21 integrally formed with the cover portion 20 and having a water passageway 210 formed therein. Several openings 211 are formed on the surface of the tube-like portion 21 to communicate the outside of the tube-like portion 21 with the passageway 210. And at least two protrusions 22 are formed at the distal end of the tube-like portion 21 away from the cover portion 20 of the plug 2.

Figure 4:
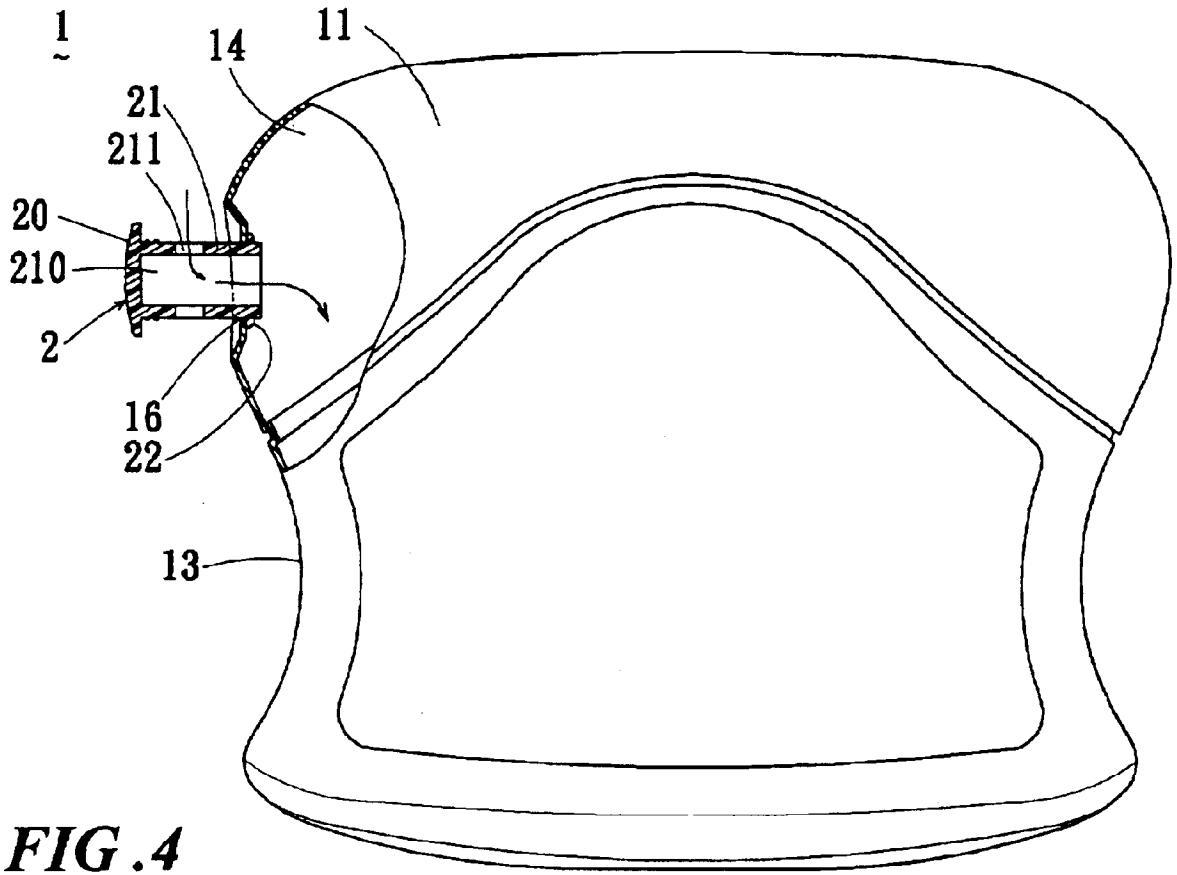
FIG. 4 is a lengthwise side plan view of the buoyancy aid as showing in FIG. 1 with a sectional-viewed portion showing the open status of the buoyancy aid.

Therefore, as referring to FIGS. 2, 3 and 4, the plug 2 is installed and inserted into the hole 16 of the body 10 and fill the hole 16 tightly by its cover portion 20. The outer radius of the tube-like portion 21 is almost same as the inner one of the hole 16 so that protrusions 22 formed on the outer surface of the tube-like portion 21 is not able to pass through the hole 16 after they are inserted into the body 10 and located in the inner space 14. Accordingly, when the plug 2 is inserted into the body 10, the hole 16 is tightly sealed by the cover portion 20 of the plug 2 so as to stop the communication of the inner space 14 with the outer circumstance. And when the plug 2 is pulled out by hand, most of the tube-like portion 21, including the openings 211, is going to expose to the outer circumstance except the distal end of the tube-like portion 21 because protrusions 22 of the tube-like portion 21 will abut against the inner face of the body 10 surrounding the hole 16 to stop the movement of the plug 2. In this instance, water or air from the outer circumstance can easily enter the inner space 14 of the body 10 by means of the openings 211 and passageway 210. It is understandable that die amount of water and air filled in the inner space 14 will affect buoyancy of the buoyancy aid 1 when the buoyancy aid 1 is placed in a swimming pool. Therefore, buoyancy of the buoyancy aid 1 is obviously adjustable by pouring water into or out of the inner space 14 of the body 10. And the buoyancy-adjustable function of the buoyancy aid 1 apparently benefits swimmers of substantially different sizes and weights according to tile actually need of the swimmers. Besides, due to the unitary formed body 10 and its inner space 14, the filled water inside the body 10 is flowable and moveable to always stay inside any water-sunk portion of the body 10. Therefore, buoyancy of the buoyancy aid 1 is almost fixed or unchanged in water so as to case the use of tile buoyancy aid 1 by a swimmer.

Figure 6:
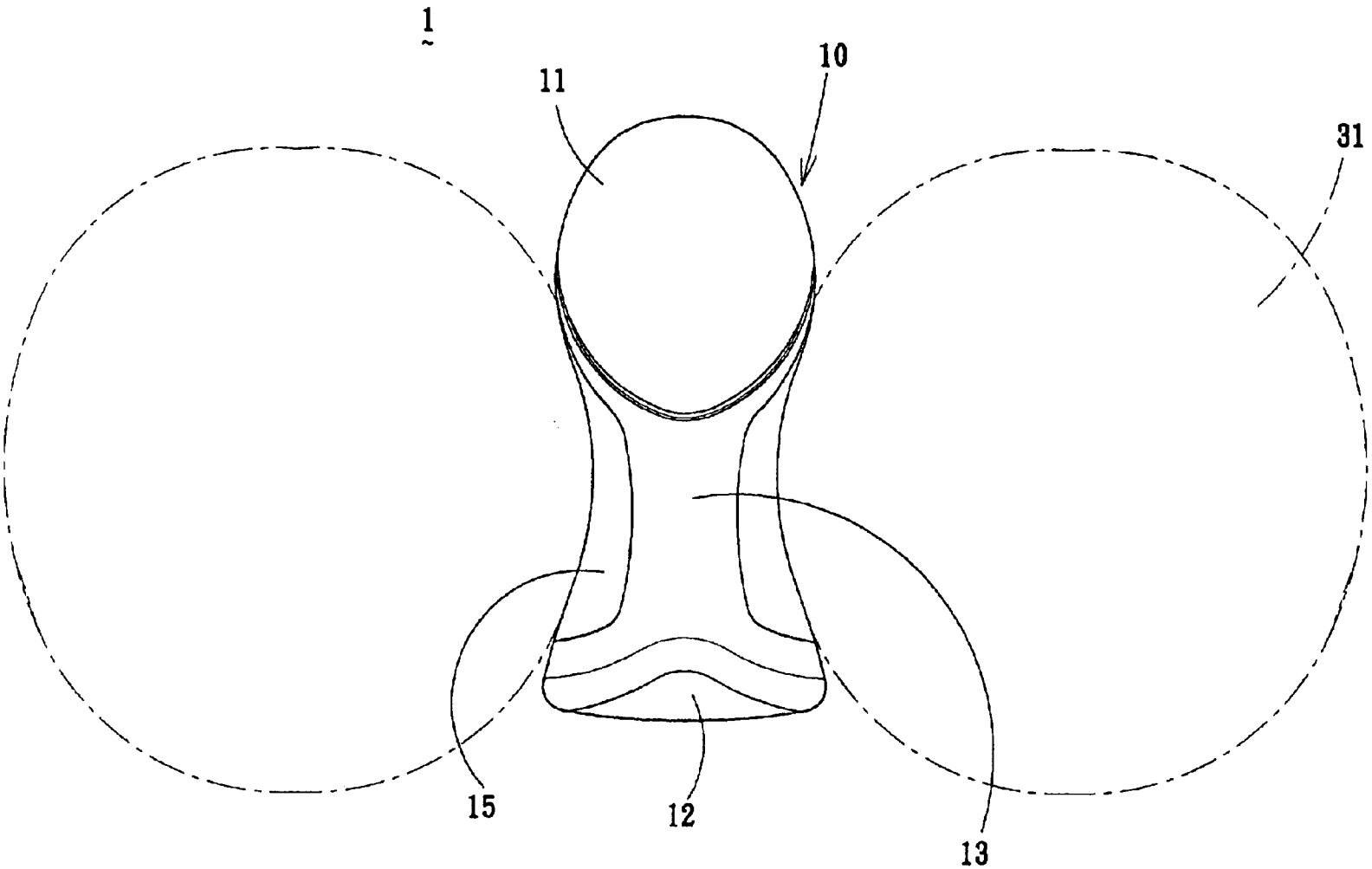
FIG. 6 is a schematic transverse side view of the buoyancy aid as showing in FIG. 1 showing the use of the buoyancy aid held by legs of swimmer.
Figure 7:
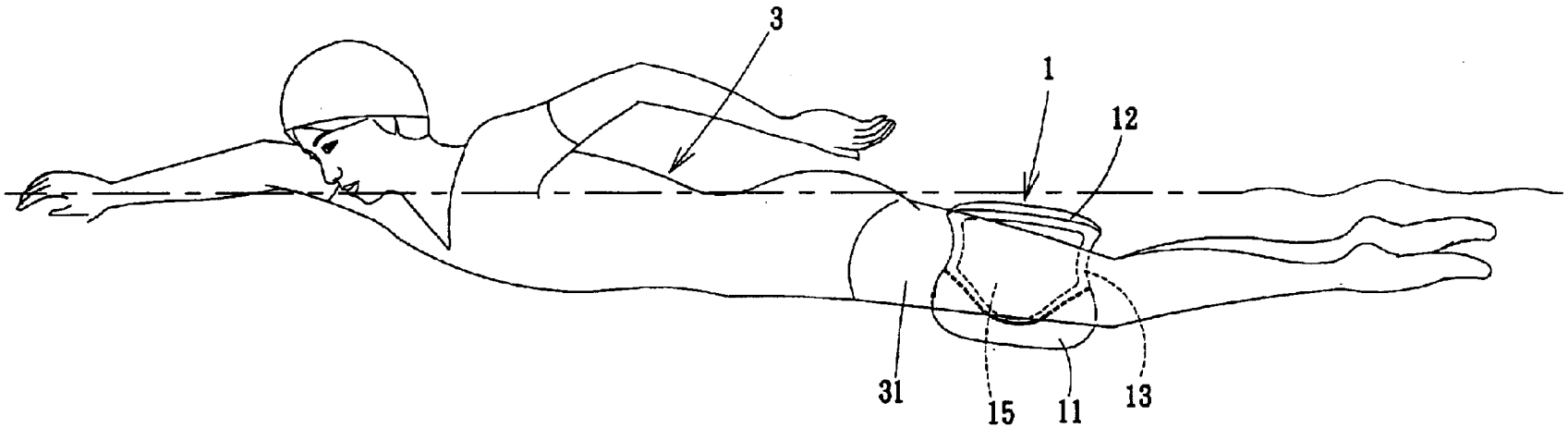
FIG. 7 is a schematic side view in accordance with the present invention showing the use of the buoyancy aid when a swimmer is swimming.

Referring to FIGS. 5, 6 and 7, because the special material of the layers 15 formed on sides of the connection portion 13 is usually soft and easily generates friction thereon when something is abutting against the layers 15, a swimmer 3 can conveniently holds the buoyancy aids between legs 31 of the swimmer 3 in a labor-saving way due to considerable friction generated between skin of legs 31 of the swimmer 3 and the layers 15 of, the buoyancy aid 1 attached thereon. Therefore, it is no need to worry about escape of the buoyancy aid 1 for the swimmer 3 during swimming due to the tight and steady contacting of the layer 15 and skin of the swimmer 3. And the soft surface of the layers 15 and the tight contacting between the layer 15 and skin of the swimmer 3 will successfully prevent skin of the swimmer 3 from being hurt.

It is to be understood, however, that even though numerous characteristics and advantages of the present invention have been set forth in the foregoing description, together with details of the method and function of the invention, the disclosure is illustrative only, and changes may be made in detail, especially in matters of ingredient, material, and arrangement of steps within the principles of the invention to the full extent indicated by the broad general meaning of the terms in which the appended claims are expressed.

What is claimed is:

1. A buoyancy aid comprising:

a) a body having first and second enlarged portions and a connection portion integrally formed therebetween, a space formed inside the body, the body having a prolate shape with a smooth outer surface, wherein the first enlarged portion includes a spherical portion that is a spherical hollow body, and the second enlarged portion includes a stopper portion that is a prolate hollow body formed respectively at two opposing sides of the body, and wherein the space extends from the first and the second enlarged portions by extending through the connection portion;

b) at least one hole formed on one side of the body and providing an entrance and exit for fluids into and out of the space; and c) a plug installed in the at least one hole including a cover portion to tightly close the hole and a tube portion integrally formed on the cover portion, wherein at least two protrusions are formed on a distal end of the tube portion away from the cover portion, and the protrusions prevent the plug from being removed from the body.

2. The buoyancy aid as recited in claim 1, wherein the tube portion includes a water passageway formed therein and a plurality of openings formed on the surface of the tube portion to communicate the outside of the tube portion with the water passageway.

3. The buoyancy aid as recited in claim 1, wherein the connection portion is recessed toward a center and a periphery of the body for holding the buoyancy aid between legs of a swimmer.

4. The buoyancy aid as recited in claim 1, further comprising two layers of material for generating friction between one of the two layers and an object abutting against the surface of the layer and adjoined to two opposing lateral faces of the connection portion.

5. A buoyancy aid for supplementing buoyancy of legs of a swimmer comprising:

a body having a prolate shape with a smooth outer surface; and at least one holding area formed on the outer surface of the body and having a friction generating layer to generate friction when skin of the swimmer abuts against the at least one holding area, wherein the body has a spherical portion and a stopper portion, and the at least one holding area is integrally formed therebetween and wherein the body includes an inner space formed in an interior and a hole formed therein providing an entrance and exit for fluids into and out of the inner space; and a plug inserted into the hole and including a cover portion to tightly close the hole and a tube portion integrally formed on the cover portion.

* * * * *